US006146721A

United States Patent [19]

Freynet

[11] Patent Number: 6,146,721

[45] Date of Patent: Nov. 14, 2000

[54] DEVICE FOR PRESENTING ALTERNATIVE FACIAL EXPRESSIONS

[76] Inventor: Robert Freynet, Box 47, Group 20, RR#2, Ste. Anne, Manitoba, Canada, R5H 1R2

[21] Appl. No.: 08/995,848

[22] Filed: Dec. 22, 1997

[51] Int. Cl.[7] ..... A63F 9/08; A47G 33/04; A63H 1/00

[52] U.S. Cl. ..... 428/7; 428/11; 273/155; 446/236

[58] Field of Search ..... 428/7, 11; 273/155; D21/478; 446/236

[56] References Cited

U.S. PATENT DOCUMENTS

| | | | |
|---|---|---|---|
| 198,589 | 12/1877 | Fabronius | 273/155 |
| 247,302 | 9/1881 | Candy | 446/71 |
| D. 274,073 | 5/1984 | Tung | D21/478 |
| 1,064,576 | 6/1913 | Washburn | 273/155 |
| 1,555,644 | 9/1925 | Duncan . | |
| 1,618,772 | 2/1927 | Merseburger . | |
| 1,762,374 | 6/1930 | Yancey . | |
| 2,584,798 | 2/1952 | Goerditz . | |
| 2,662,339 | 12/1953 | Paul . | |
| 2,669,802 | 2/1954 | Oliver . | |
| 2,931,657 | 4/1960 | Lewis . | |
| 2,935,814 | 10/1960 | Freeze | 273/155 |
| 3,538,638 | 11/1970 | Glass et al. . | |
| 3,717,942 | 2/1973 | Presby | 434/402 |
| 3,830,012 | 8/1974 | Franke . | |
| 3,961,439 | 6/1976 | Moustakas . | |
| 4,407,502 | 10/1983 | Paulos | 273/153 S |
| 4,445,691 | 5/1984 | Stark et al. | 273/155 |
| 4,651,992 | 3/1987 | Damino et al. . | |
| 4,865,324 | 9/1989 | Nesis . | |
| 5,083,788 | 1/1992 | Conotter | 273/153 S |
| 5,788,232 | 8/1998 | Binkley | 273/155 |

FOREIGN PATENT DOCUMENTS

| | | |
|---|---|---|
| 1199351 | 1/1986 | Canada . |

*Primary Examiner*—Jill Warden
*Assistant Examiner*—Latoya I. Cross
*Attorney, Agent, or Firm*—James E. Gastle

[57] ABSTRACT

Disclosed herein is a device for presenting alternative facial expressions, comprising: a first portion having a plurality of regions thereon. Each region includes indicia representative of an upper section of a face including a pair of eyebrows and each representation in a given region bears a unique representation from the representations of the other regions of the first portion. A second portion has a plurality of regions thereon, each region having indicia thereon representative of a middle section of face and including a pair of eyes; each representation in a given region bearing a unique representation from the representations of the other regions of the second portion. A third portion has a plurality of regions thereon, each region having indicia thereon representative of a lower section of the face and including a mouth; each representation in a given region bearing a unique representation from the representations of the other regions of the third portion. The second portion further comprises a first border which is complementary with a corresponding border on the first portion and a second border which is complementary with a corresponding border on the third portion. The first, second and third portions are arranged to present any one of the regions on each corresponding portion to present one of a number of possible facial expressions.

7 Claims, 22 Drawing Sheets

DEVICE FOR PRESENTING ALTERNATIVE FACIAL EXPRESSIONS

TECHNICAL FIELD

The present invention relates to facial expressions and more particularly to devices for forming alternative expressions.

BACKGROUND ART

For as long as recorded history, the human facial expression has been a source of great fascination and figures prominently in the works of the world's greatest artists. While many artists have the ability to draw a true likeness of a facial expression with ease, most people find this task challenging at best and usually a frustrating experience, to the extent that drawing a true likeness of a facial expression is simply impossible. Nonetheless, the desire to have the ability remains.

It is an object of the present invention to provide a novel device for forming alternative facial expressions.

DISCLOSURE OF THE INVENTION

Briefly stated, the invention involves a device for presenting alternative facial expressions, comprising:

a first portion having a plurality of regions thereon, each region including indicia representative of an upper section of a face including a pair of eyebrows, each representation in a given region bearing a unique representation from the representations of the other regions of the first portion;

a second portion having a plurality of regions thereon, each region having indicia thereon representative of a middle section of face and including a pair of eyes; each representation in a given region bearing a unique representation from the representations of the other regions of the second portion;

a third portion having a plurality of regions thereon, each region having indicia thereon representative of a lower section of the face and including a mouth; each representation in a given region bearing a unique representation from the representations of the other regions of the third portion;

the second portion further comprising a first border which is complementary with a corresponding border on the first portion and a second border which is complementary with a corresponding border on the third portion;

wherein the first, second and third portions are arranged to present any one of the regions on each corresponding portion to present one of a number of possible facial expressions.

In another aspect of the present invention, there is provided a rubber stamp assembly, comprising:

a plurality of first stamp elements, each having an ink receiving surface thereon which includes indicia representative of an upper section of a face including a pair of eyebrows, the representation of each first stamp element bearing a unique representation from the representations of the other of the first stamp elements;

a plurality of second stamp elements, each having an ink receiving surface thereon which includes indicia representative of an upper section of a face including a pair of eyes, the representation of each second stamp element bearing a unique representation from the representations of the other of the second stamp elements;

a plurality of third stamp elements, each having an ink receiving surface thereon which includes indicia representative of an upper section of a face including a pair of eyes, the representation of each third stamp element bearing a unique representation from the representations of the other of the third stamp elements;

each of the second stamp elements further comprising a first border which is complementary with a corresponding border on each of the first stamp elements and a second border which is complementary with a corresponding border on each of the third stamp elements;

wherein the first, second and third stamp elements are capable of presenting a number of alternative facial expressions depending on the selection of the first, second and third stamp elements.

In still another aspect of the present invention, there is provided an embossing assembly, comprising:

a plurality of first embossing elements, each having a substrate receiving surface thereon which includes indicia representative of an upper section of a face including a pair of eyebrows, the representation of each first embossing element bearing a unique representation from the representations of the other of the first embossing elements;

a plurality of second embossing elements, each having a substrate receiving surface thereon which includes indicia representative of an upper section of a face including a pair of eyes, the representation of each second embossing element bearing a unique representation from the representations of the other of the second embossing elements;

a plurality of third embossing elements, each having a substrate receiving surface thereon which includes indicia representative of an upper section of a face including a pair of eyes, the representation of each third embossing element bearing a unique representation from the representations of the other of the third embossing elements;

each of the second embossing elements further comprising a first border which is complementary with a corresponding border on each of the first embossing elements and a second border which is complementary with a corresponding border on each of the third embossing elements;

wherein the first, second and third embossing elements are capable of presenting a number of alternative facial expressions depending on the selection of the first, second and third embossing elements.

BRIEF DESCRIPTION OF THE DRAWINGS

Several preferred embodiments of the present invention will now be described, by way of example only, with reference to the appended drawings in which.

BEST MODE FOR CARRYING OUT THE INVENTION

Referring to the figures, and more particularly to FIGS. 1 to 9, there is provided a device 10 for presenting alternative facial expressions, comprising a first portion 12 having a plurality of regions 12*a* thereon, each region 12*a* including indicia representative of an upper section of a face including a pair of eyebrows, each representation in a given region bearing a unique representation from the representations of the other regions of the first portion.

A second portion is provided at 14 with a plurality of regions 14*a* thereon, each region having indicia thereon representative of a middle section of face and including a pair of eyes; each representation in a given region 14*a* bearing a unique representation from the representations of the other regions of the second portion.

A third portion is provided at 16 with a plurality of regions 16*a* thereon, each region having indicia thereon representative of a lower section of the face and including a mouth; each representation in a given region bearing a unique representation from the representations of the other regions of the third portion.

Figure 1:
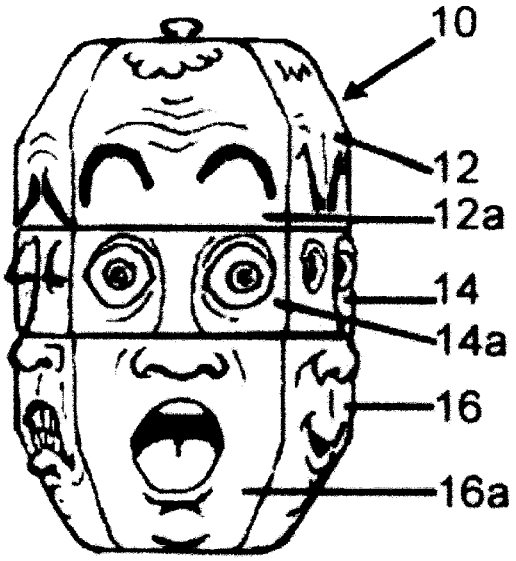
FIG. 1 is a side view of a device for presenting alternative facial expressions in one facial configuration.
Figure 2:
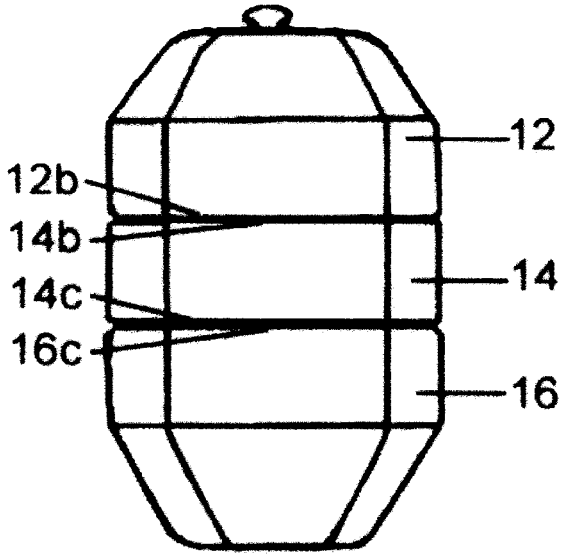
FIG. 2 is a side view of the device of FIG. 1 without indicia thereon.

Referring to FIG. 2, the second portion further comprises a first, in this case upper, border 14*b* which is complementary with a corresponding border 12*b* on the first portion 12 and a second, in this case lower, border 14*c* which is complementary with a corresponding border 16*c* on the third portion 16.

In this case, the first, second and third portions are arranged to present any one of the regions on each corresponding portion to present one of a number of possible facial expressions.

Figure 4:
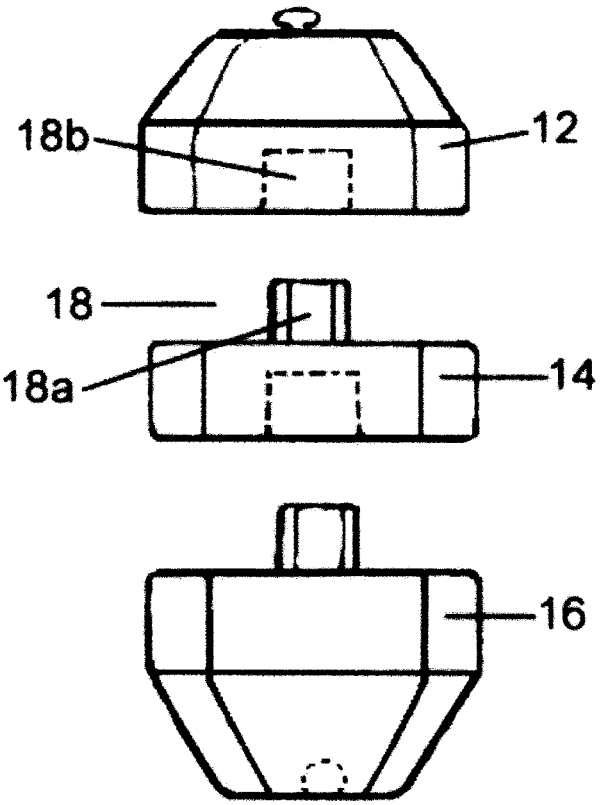
FIG. 4 is an assembly view of the device of FIG. 2.
Figure 5:
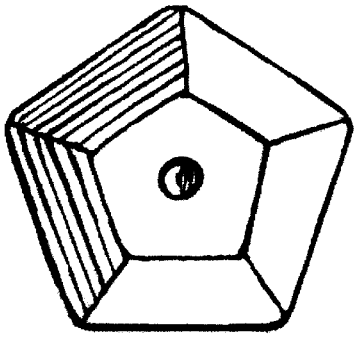
FIG. 5 is a bottom plan view of the device of FIG. 2.
Figure 6:
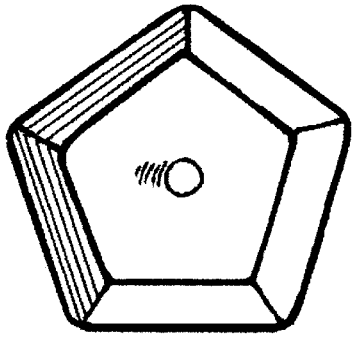
FIG. 6 is a top plan view of the device of FIG. 2.
Figure 7:
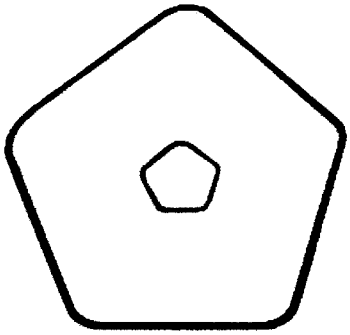
FIG. 7 is a top plan view of a middle portion of the device of FIG. 2 taken on line 7—7 of FIG. 4.
Figure 8:
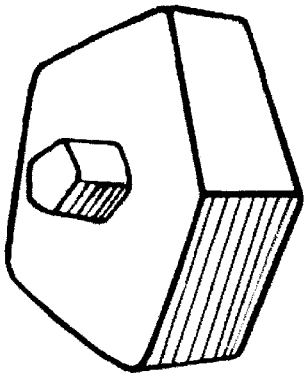
FIG. 8 is a perspective view of the middle portion of FIG. 7.
Figure 9:
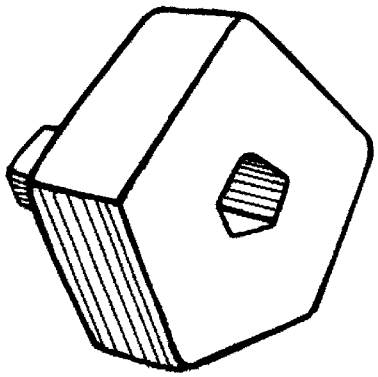
FIG. 9 is another perspective view of the middle portion of FIG. 7.
Figure 10:
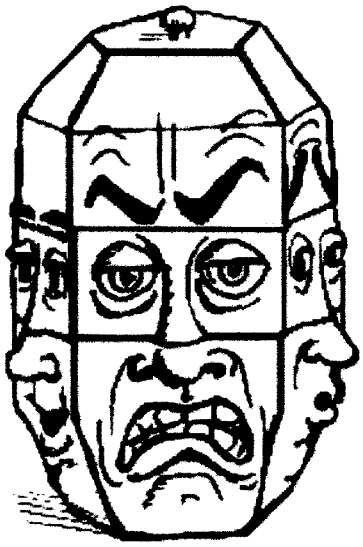
FIG. 10 is perspective view of the device of FIG. 1 in another facial configuration.
Figure 11:
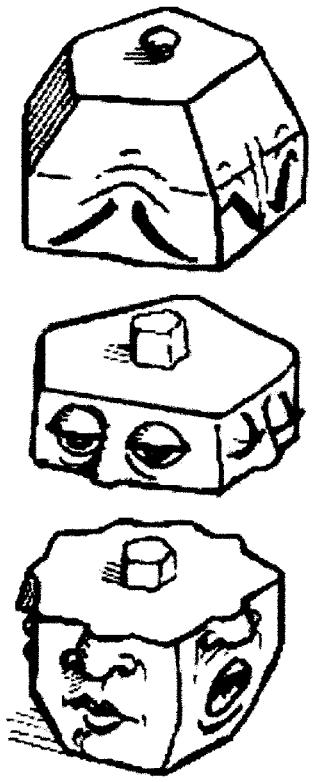
FIG. 11 is a perspective assembly view of the device of FIG. 10.
Figure 12:
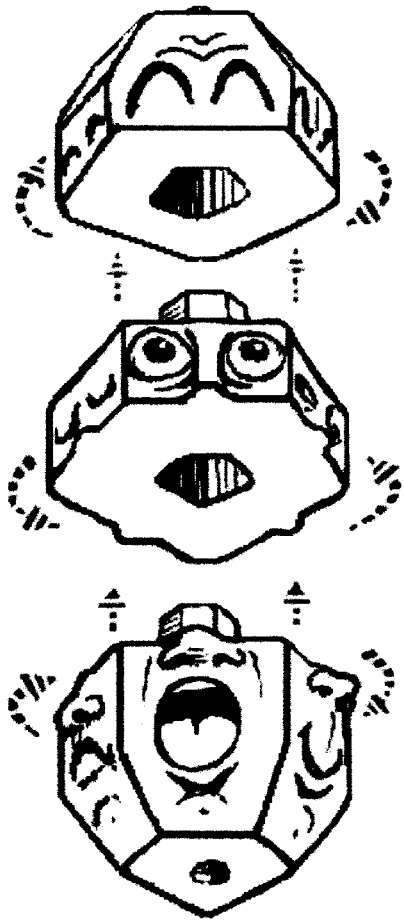
FIG. 12 is another perspective assembly view of the device of FIG. 10.

Referring to FIG. 4, the first, second and third portions each comprise block members 12, 14 and 16, having a plurality of peripheral faces thereon, each of which corresponds to one of the regions.

Figure 3:
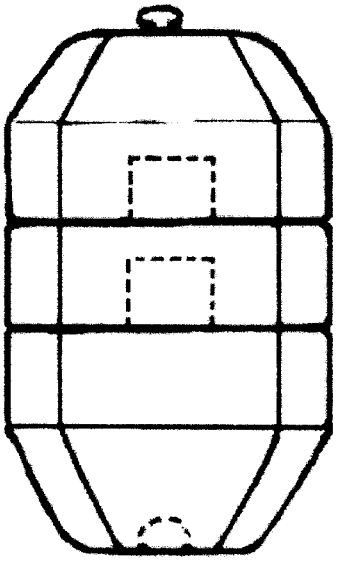
FIG. 3 is a sectional view of the device of FIG. 2.

Attachment means 18 is provided for removably attaching the first, second and third portions together for relative movement between. In the case of FIGS. 3 and 4, the attachment means includes a male part, in the form of a projection 18*a*, formed in one end of the portions and a female part, in the form of a recess 18*b* complementary to the projection, and formed in the other end of the portions, wherein the projection of one of the portions engages with a recess of an adjacent one of the projections for relative movement therebetween. It can also be seen that each projection has a plurality of outer peripheral faces thereon, the recess has a plurality of inner peripheral faces therein and equal in number to the plurality of outer peripheral faces, so that the adjacent portions will be naturally inclined to seat relative to one another thereby to align to corresponding adjacent regions.

The portions may be formed in any one of a number of techniques, including using molded plastics materials. In this case, the dimensions of the projection and recess must be such to allow relative movement therebetween.

The indicia may be provided by painting the indicia directly onto the faces or by applying indicia-bearing labels onto the faces. Alternatively, the indicia may be provided in relief.

The device 10 provides a system whereby a user can easily create various facial expressions for amusement or creative purposes. This can be done by simply aligning an 'eyebrow' region, an 'eye' region and a 'mouth' region from any one of the regions presented on the first, second and third portions respectively. The adjustment means should be such as to allow the user to move one adjacent portion relative to the other with relatively little effort and yet be firm enough to keep the portions in place during use. The attachment means above described is particular useful since each projection is inclined to seat relative to the recess when the outer and inner peripheral faces are aligned, thereby to align to corresponding adjacent regions.

Moving any one of the portions relative to the other and aligning a new region with the previous two will present a different facial expression, depending of course on the portion moved and the region selected.

Not only do the 'eyebrow' region, an 'eye' region and a 'mouth' region provide representations of the eyebrow, the eye and the mouth respectively, they do so exclusively as well. In other words, the representations of the eyebrow, the eye and the mouth do not migrate into adjacent neighbouring portions. What does migrate between the portions are the representations of the other aspects of the face such as the outer profile of the face and perhaps other features which are common to adjacent representations. For example, the eye and the eyebrow representations may have a pair of wrinkles on either side of the nose which extend upwardly into the eyebrow region. In this case, the upper extension of each wrinkle would preferably be present in every representation of the eyebrow shown by that portion of the device.

Figure 13:
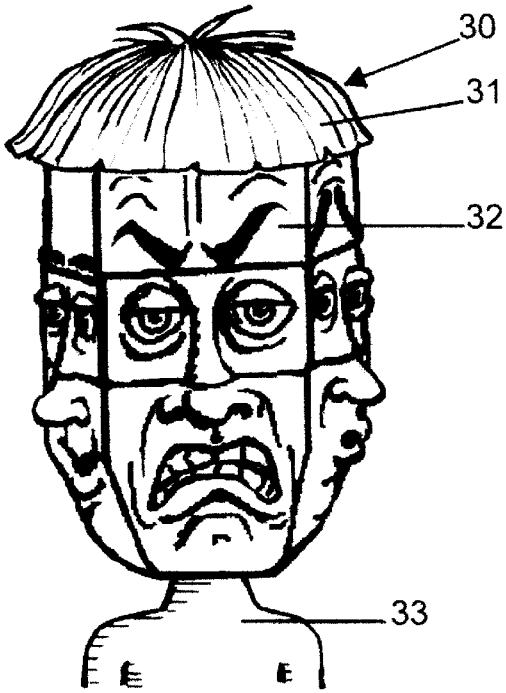
FIG. 13 is a perspective views of another devices, similar to the device of FIG. 1, for presenting alternative facial expressions.
Figure 14:
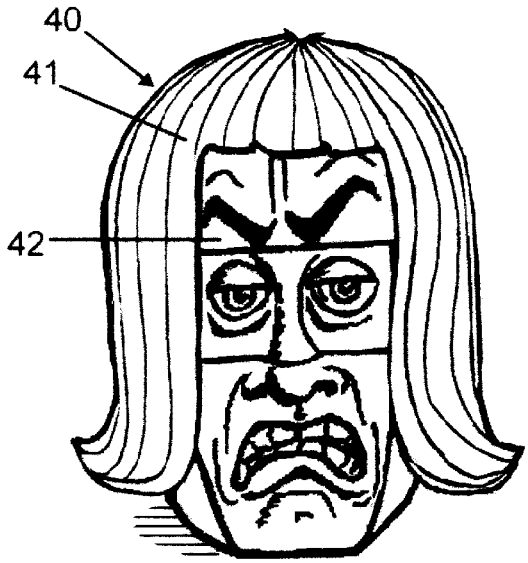
FIGS. 14, 15, 16, 17 and 18 are perspective views of other devices, similar to the device of FIG. 1, for presenting alternative facial expressions.
Figure 15:
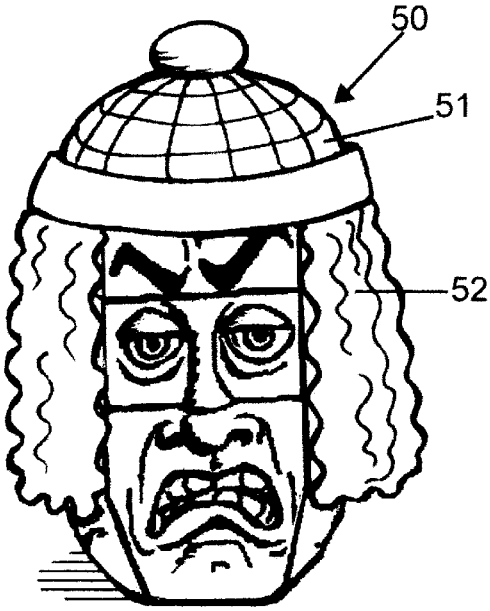

FIGS. 13 to 15 show devices 30, 40 and 50, each of which with a hair piece 31, 41, 51 respectively, which is removably secured to the first portion 32, 42, 52 respectively.

Figure 13A:
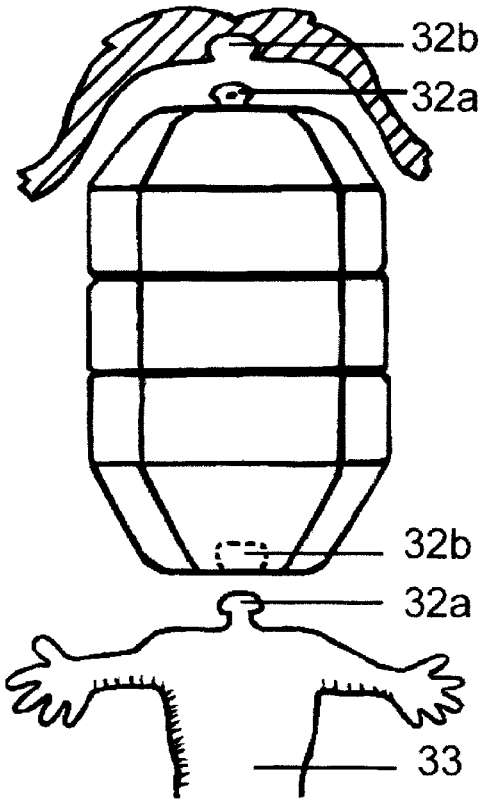
FIG. 13*a* is a part sectional assembly view of the device of FIG. 13.
Figure 13B:
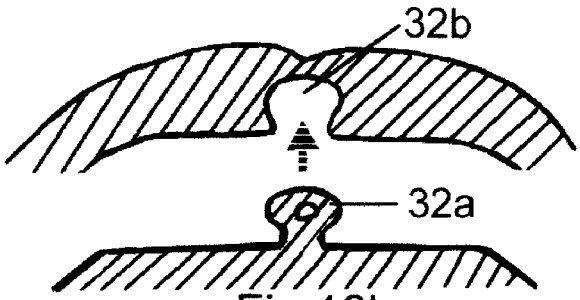
FIG. 13*b* is a magnified view of a portion of the device of FIG. 13.
Figure 13C:
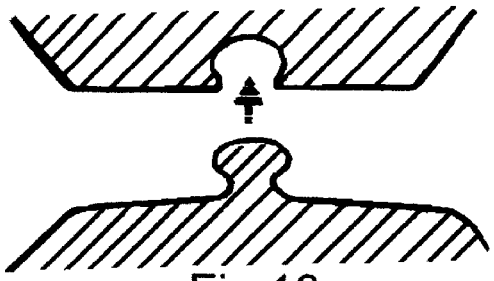
FIG. 13*c* is a magnified view of another portion of the device of FIG. 13.

Referring to FIGS. 13*a*, 13*b* and 13*c*, this is achieved by the use of a removable coupling in the form of a pair of complementary engagement members, such as with a male and female snap members 32*a*, 32*b*. In this case, one of the members is provided on the first or third portions and the other is provided on the accessory, be it the hair piece 31 or the body portion as shown at 33. Of course, the male and female snap members may be reversed to the arrangement shown above.

Of course, other complementary engagement members may be used such as hook and loop fasteners commonly known by the trademark VELCRO, magnets, removable adhesives and the like.

Figure 16:
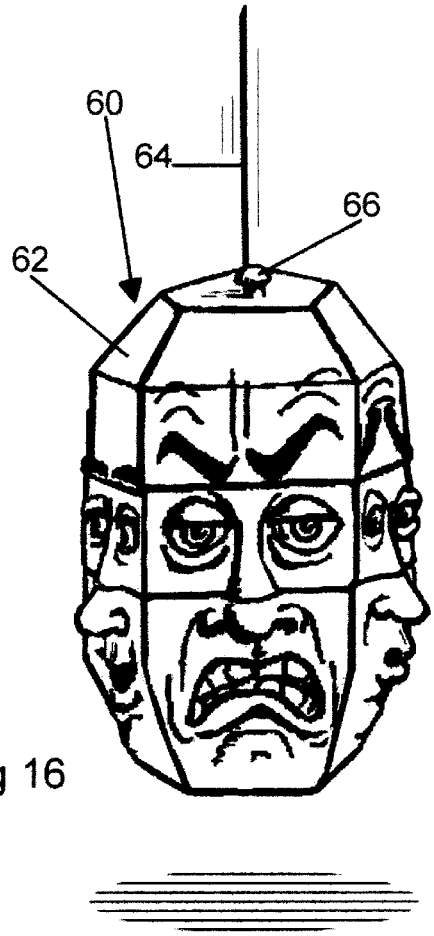
Figure 17:
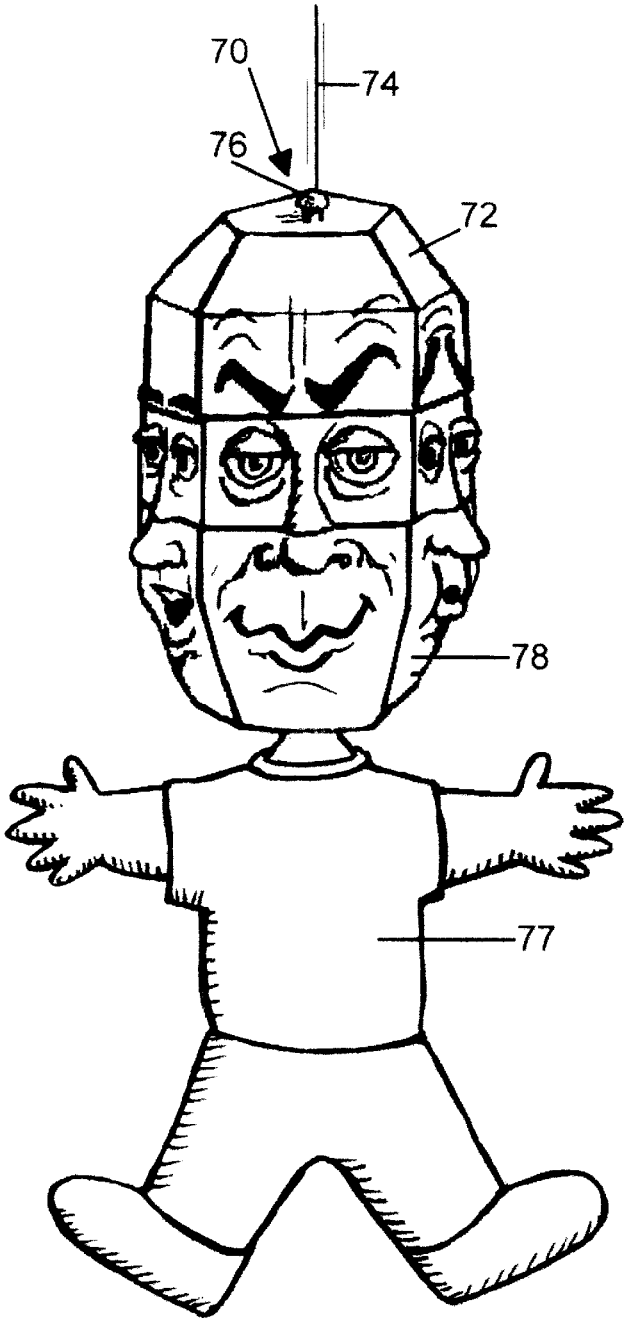

FIGS. 16 and 17 show a devices 60 and 70 with their respective first portions 62 72 tied to a cord 64, 74 by way of a knob 66, 76.

Referring to FIG. 17, the device 70 is also provided with a body portion 77 attached to the third portion 78, which is removably coupled with the third portion as described above.

Figure 18:
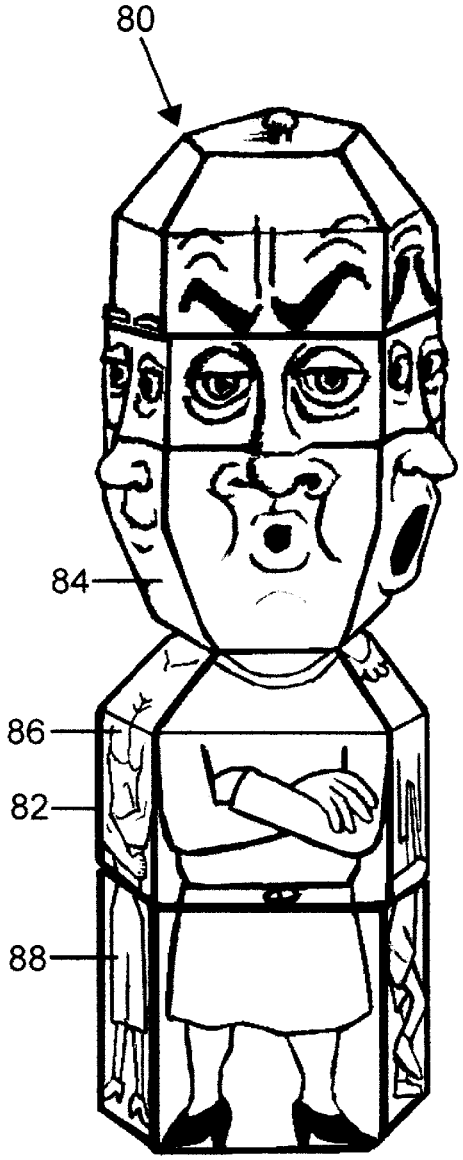
Figure 19:
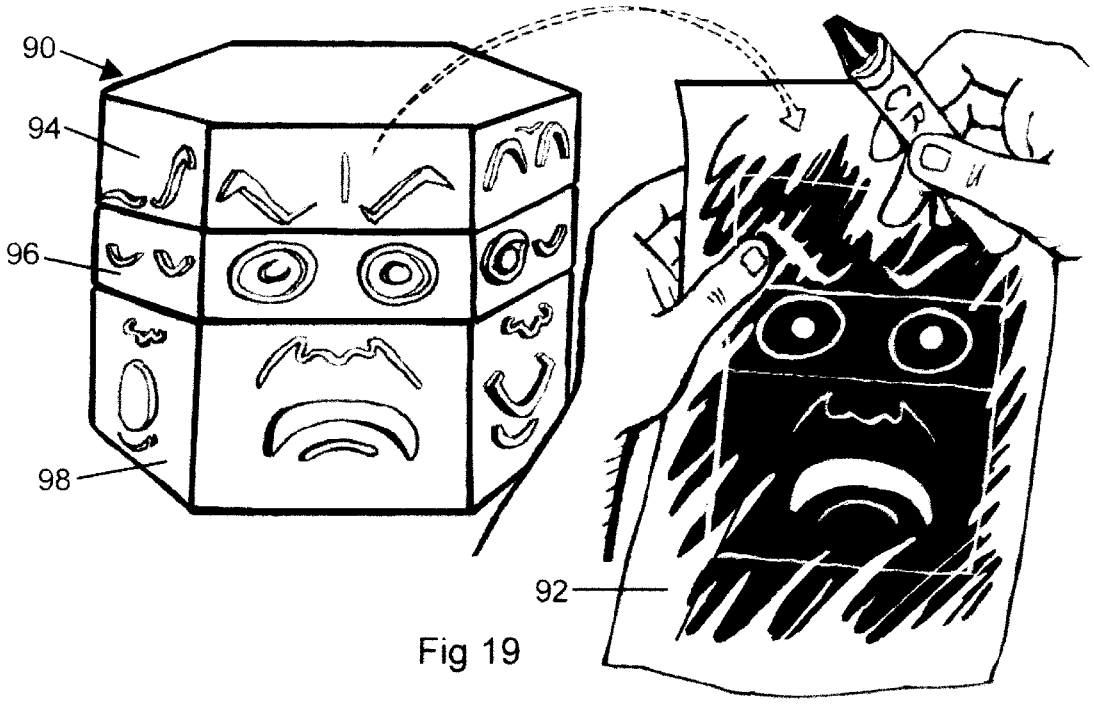
FIGS. 19, 20 and 21 are perspective operational views of yet other devices, in use, for presenting alternative facial expressions.

FIG. 18 shows a device 80 which has a body portion 82 which is attached to the third portion 84. In this case, the body portion 82 itself provides a fourth portion 86 and a fifth portion 88, both of which have a plurality of regions thereon. The regions on the fourth portion 86 include indicia representative of an upper section of a costume, while the regions on the fifth portion 88 include indicia representative of a lower section of a costume Referring to FIG. 19, there is provided an embossing device 90 for embossing alternative facial expressions onto a substrate shown at 92. As with the embodiment shown in FIG. 1, the device 90 comprises a first portion 94, a second portion 96 and a third portion 98, all of which have a plurality of regions with indicia thereon representative of an upper section, a middle section and a lower section respectively of a face.

In this case, the indicia is provided in relief so that the image provided by the indicia may be formed on the substrate simply by pressing the substrate against any one of the assembled composite surfaces presenting a particular facial expression, and then 'rubbing' the substrate with an appropriate writing implement.

The device 90 may be included in, if desired, in an embossing kit with a collection of writing implements, such as crayons, pencils, pens and the like, as well as instructions to form the alternative facial expressions therewith.

Figure 20:
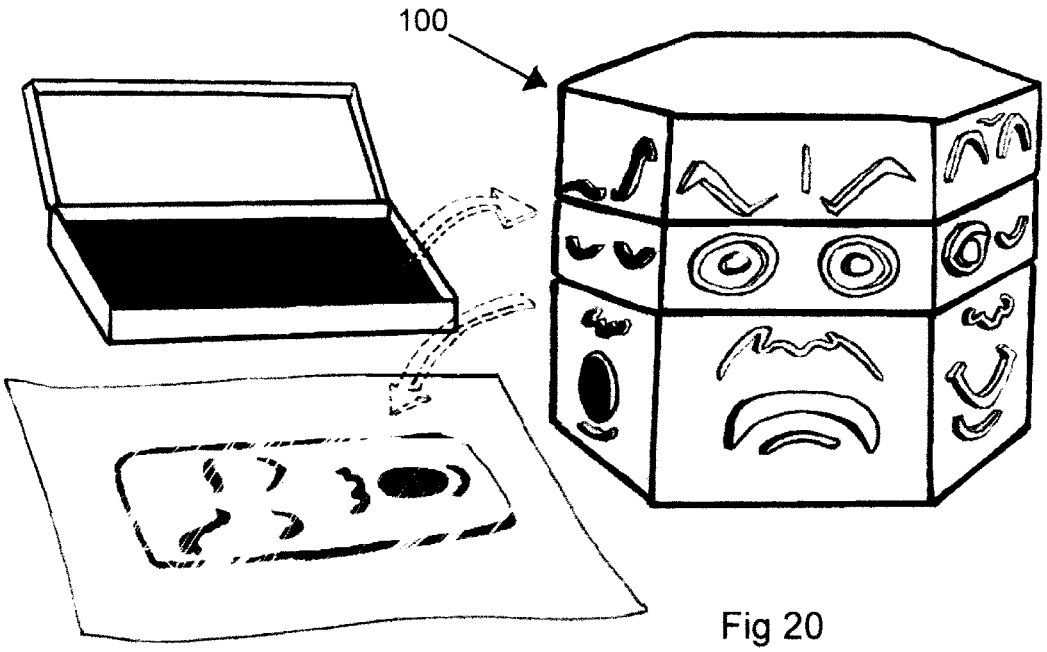

FIG. 20 illustrates a stamping kit which includes a stamp device 100 which is identical to the embossing device 90, except that the surface in each region is rubberized so that it lends itself to picking up ink when pressed against an ink pad and then transferring the ink to a substrate when pressed thereagainst.

Figure 21:
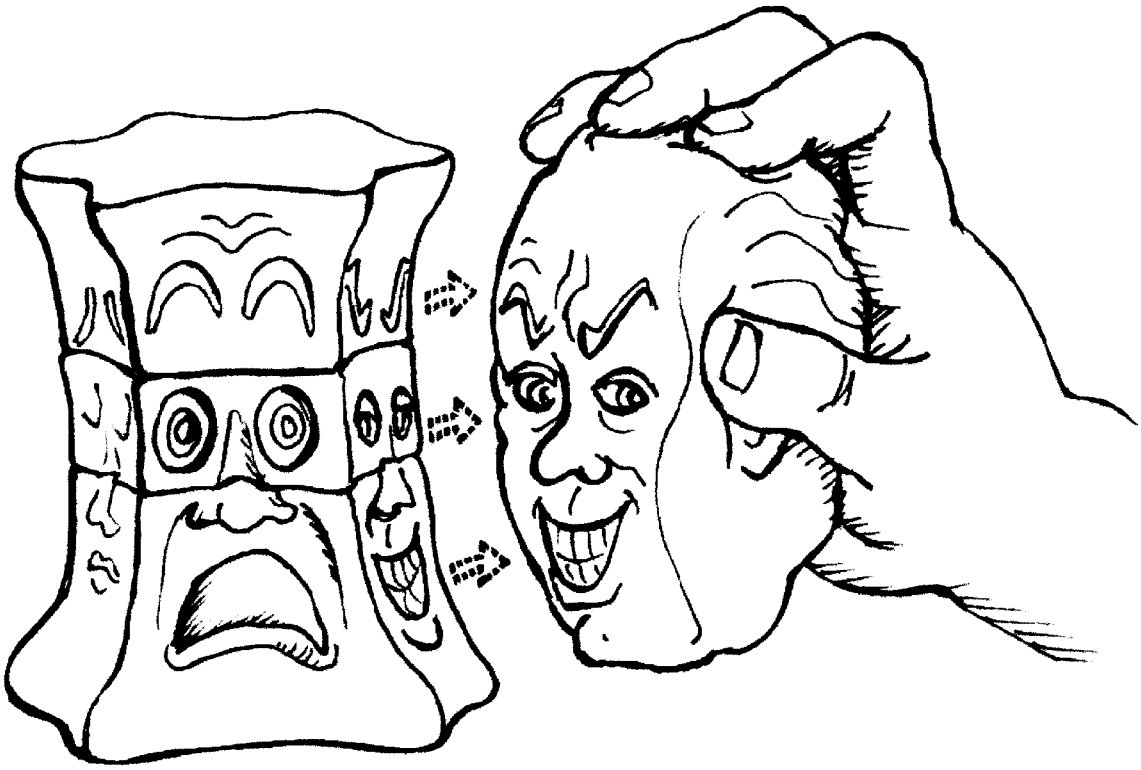

FIG. 21 illustrates another embossing device 110 which is identical to the embossing device 90, except that the surface in each region is concave so that it can be engaged with a ball of forming putty to form an impression thereon.

Figure 22:
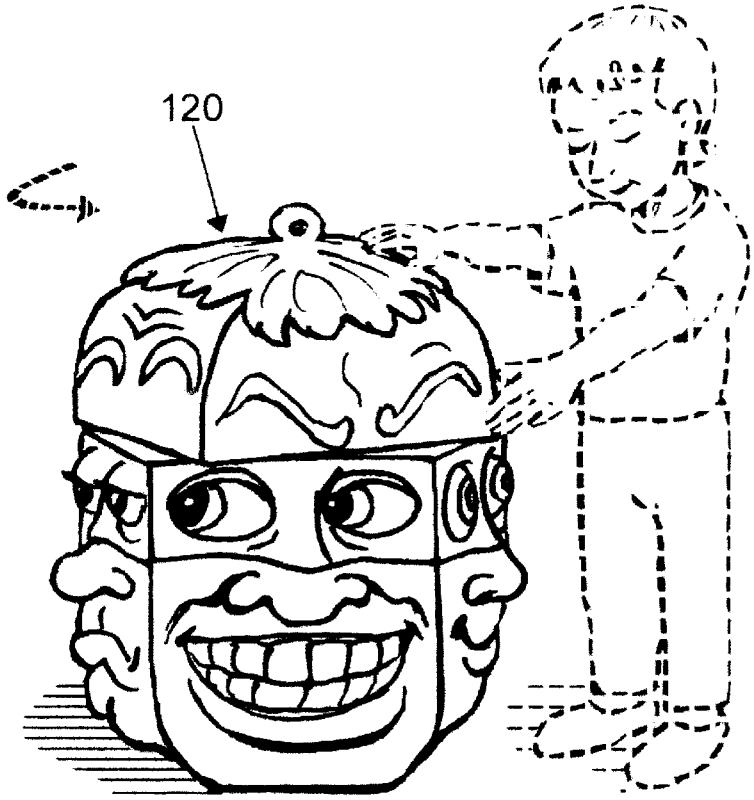
FIG. 22 is perspective views of still another devices for presenting alternative facial expressions.
Figure 22A:
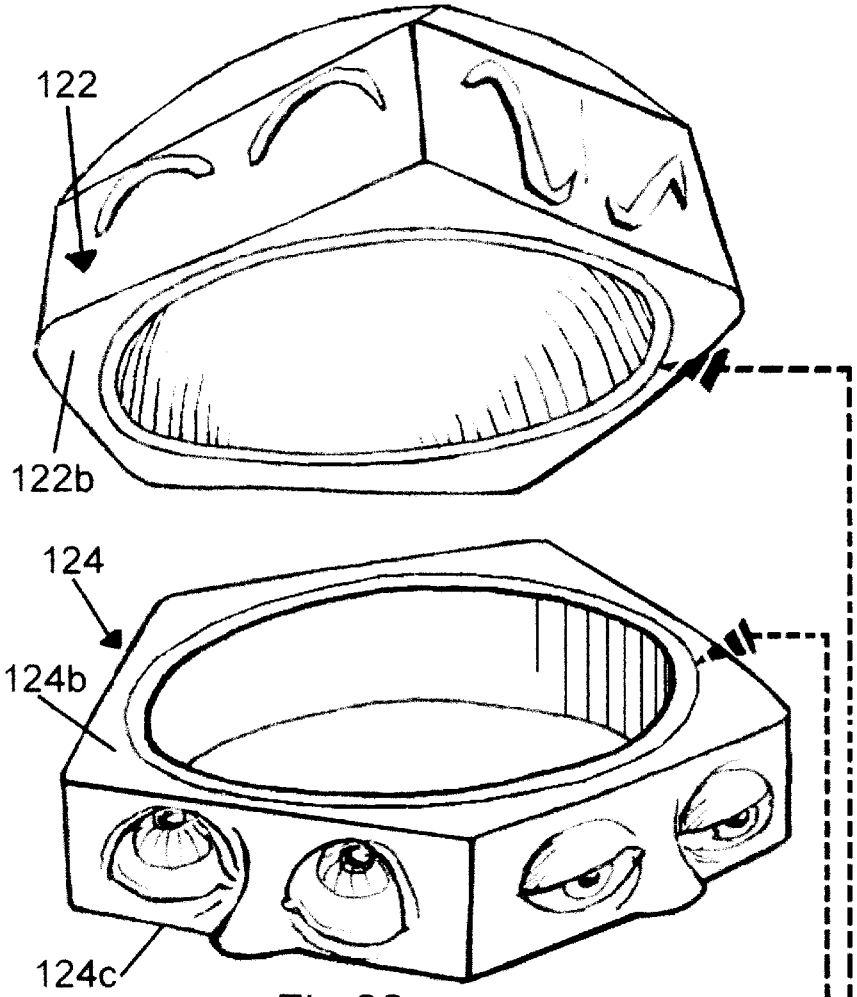
FIG. 22*a* is an assembly view of a portion of the device illustrated in FIG. 22.
Figure 22B:
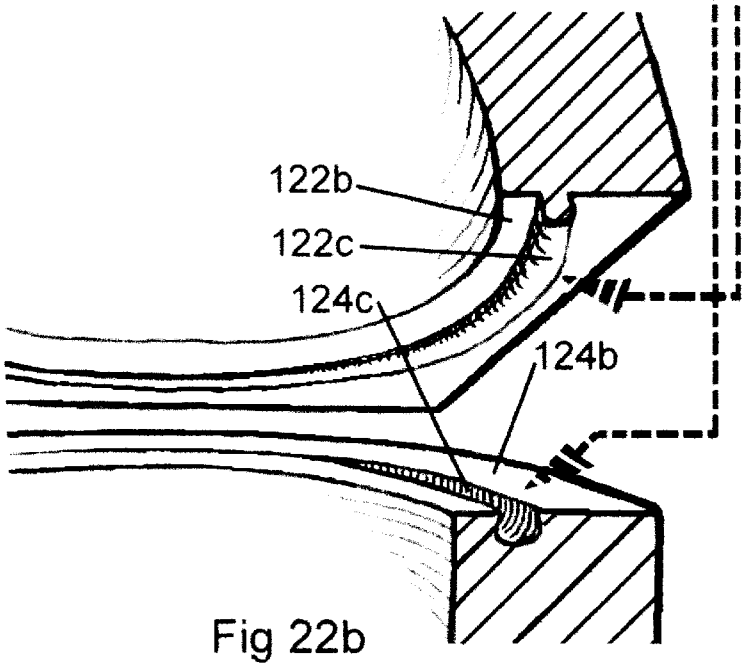
FIG. 22*b* is a magnified view of a segment of the portion shown in FIG. 22*a;*

FIG. 22 illustrates still another device 120 for presenting alternative facial expressions. The device 120 is relatively large and may be conveniently formed from blow molding techniques. As described earlier, the device has a first portion 122 and a second portion 124. As shown in FIGS. 22*a* and 22*b*, the second portion is provided with a first, in this case upper, border 124*b* which is complementary with a corresponding border 122*b* on the first portion 122. Located in the border 124*b* is an annular channel 124*c* which is complementary to and engaged with a corresponding annular ridge 122*c*.

Figure 23:
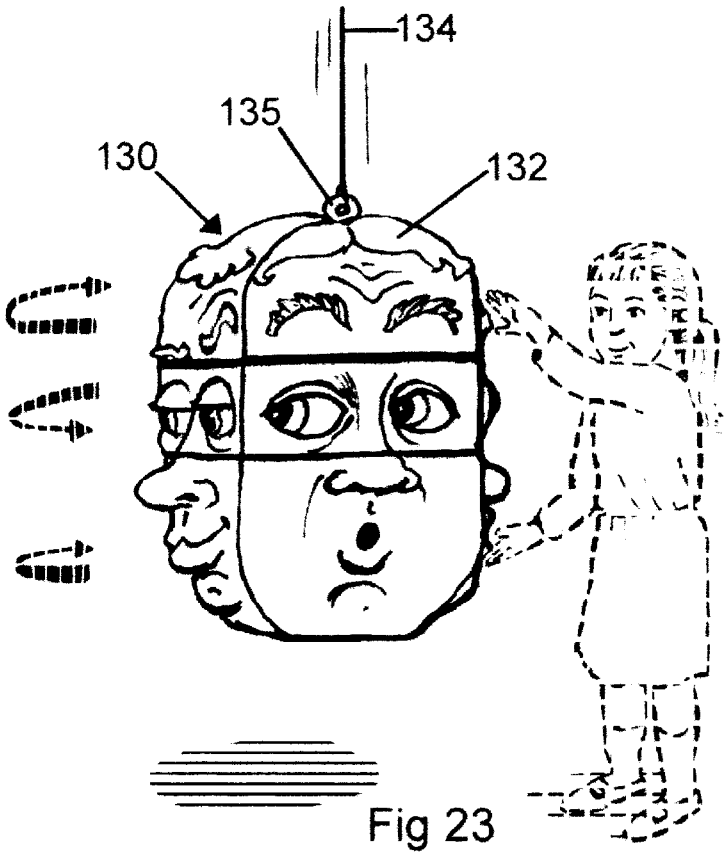
FIG. 23 is a perspective view of still another device for presenting alternative facial expressions.
Figure 23A:
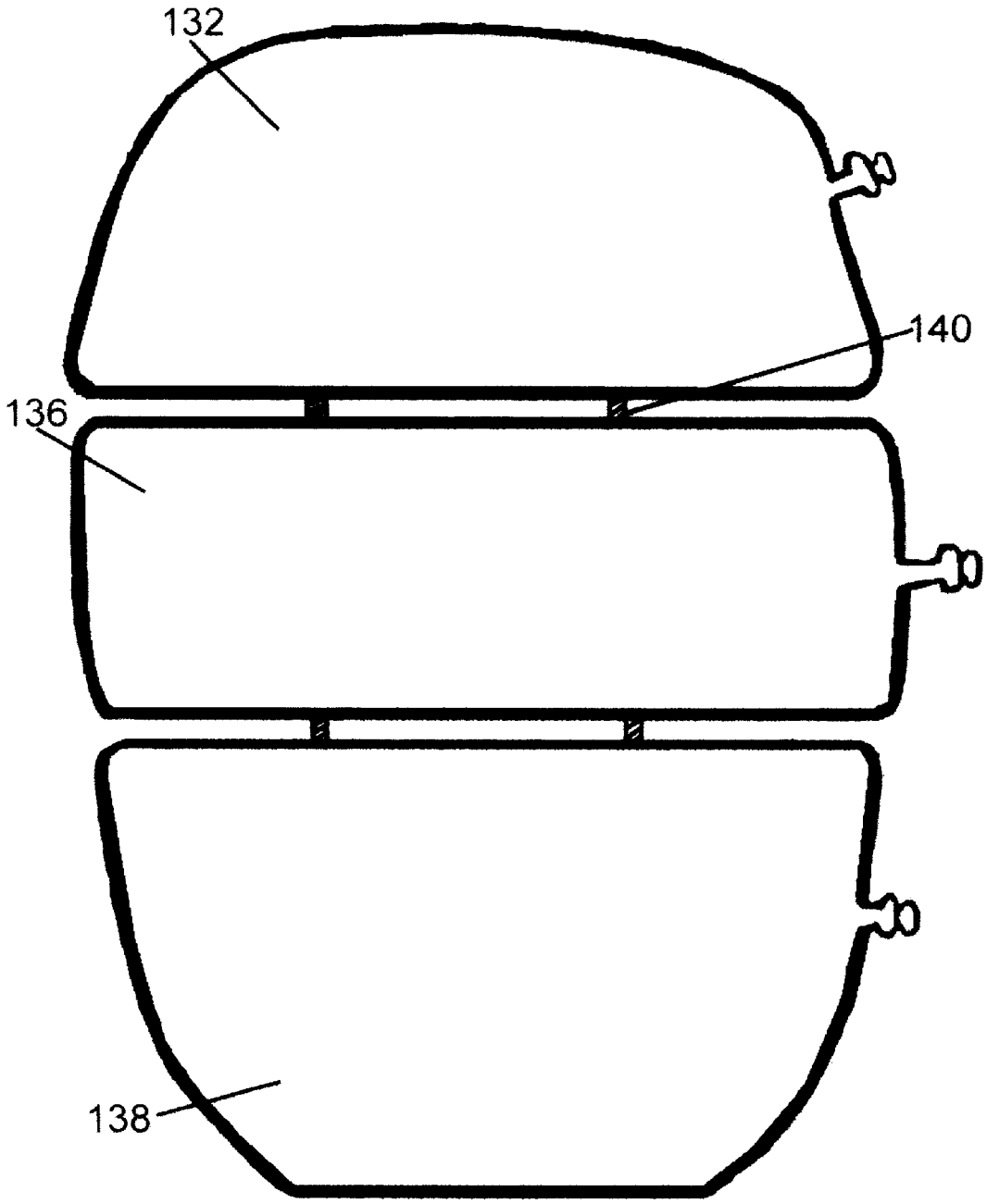
FIG. 23*a* is a sectional view of the device shown in FIG. 23.
Figure 28:
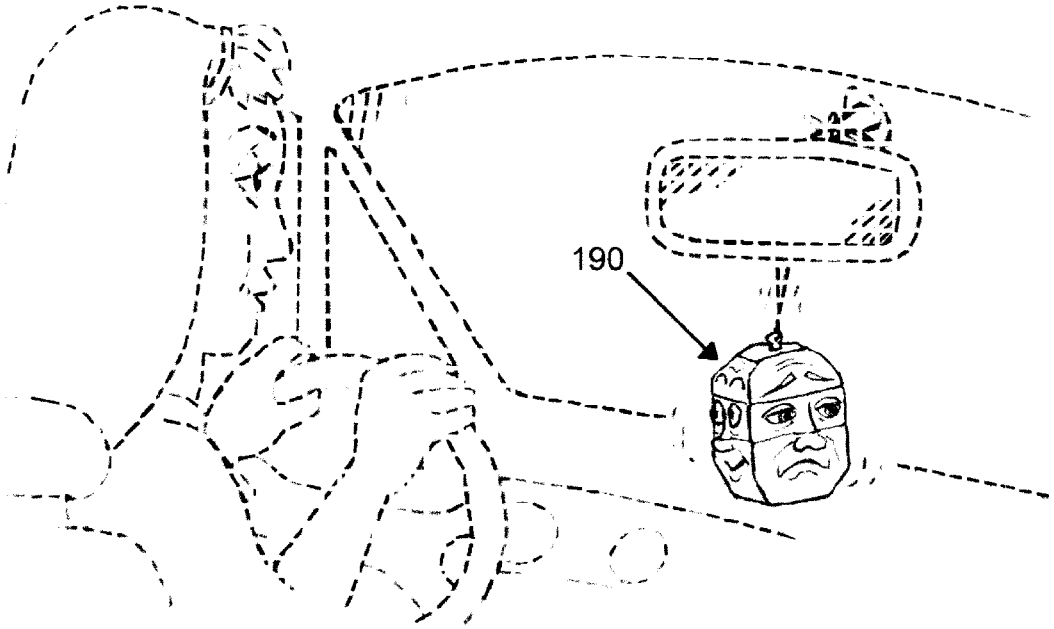

FIGS. 23 and 28 illustrate still other devices 130 and 190 for presenting alternative facial expressions. Like the device 120, the device 130 is relatively large and may be conveniently formed from blow molding techniques. In the case of FIG. 23 (as well as for device 190), the device 130 has a first portion 134 with a knob 135, itself having an aperture for tied connection to a cord 134. If desired, the device 130 may also be inflatable, as shown by FIG. 23*a*, that is by making each of the first, second and third portions 132, 136, 138 inflatable and then providing a connection between them as shown at 140 to allow them to be moved relative to one another.

Figures 24, 25:
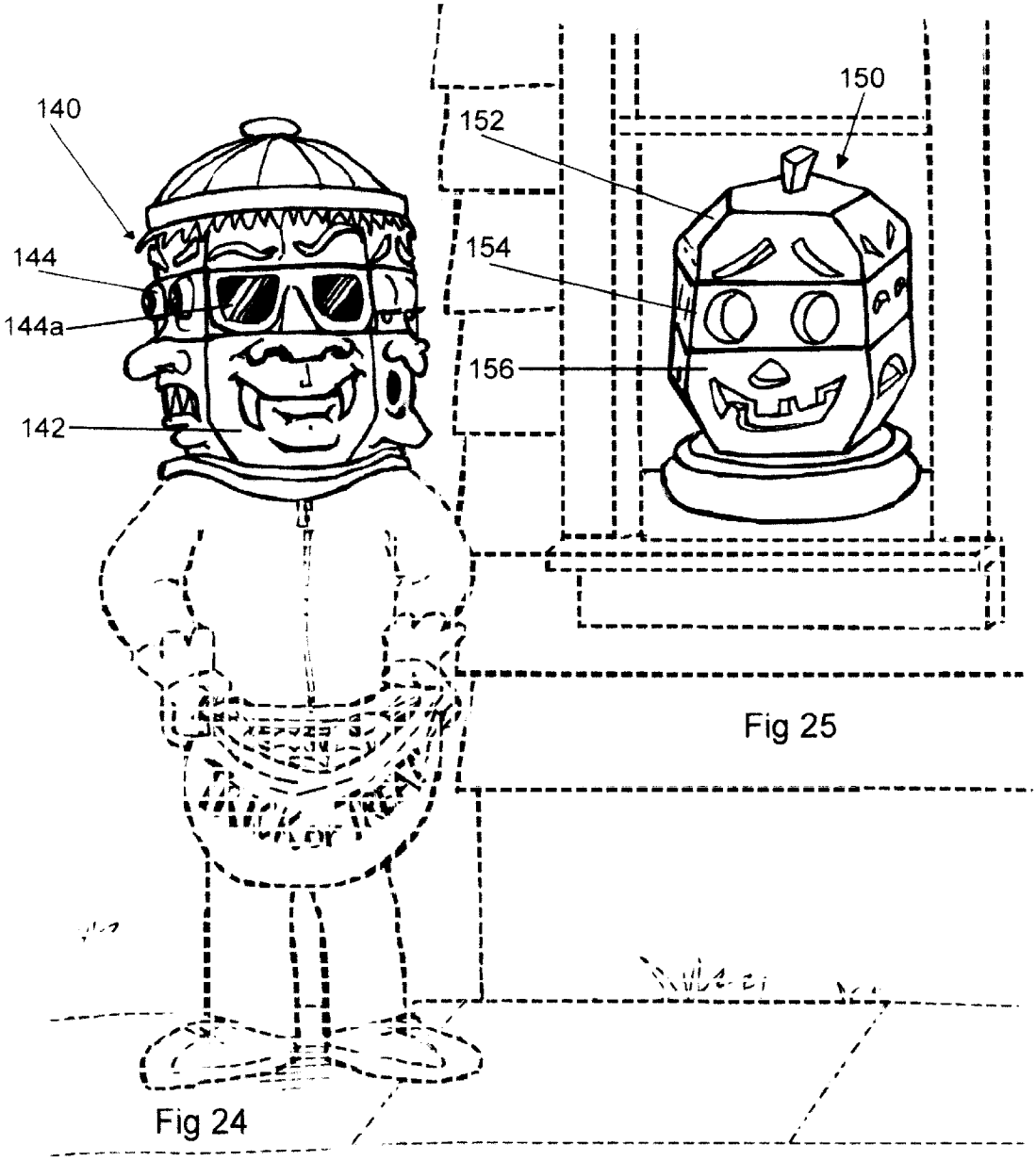
FIGS. 24, 25, 26, 27, 28, 29 and 30 are perspective views of still other devices for presenting alternative facial expressions.

FIG. 24 illustrates a device 140 for presenting alternative facial expressions in the form of a mask. The lower portion 142 has an aperture which is sufficiently large to allow a user's head to pass therethrough. The second portion 144 is also provided with eye passages 144*a* in each of the representations of the eyes and the eye passages are dimensioned to allow the user to see through the passages while wearing the device.

Figure 26:
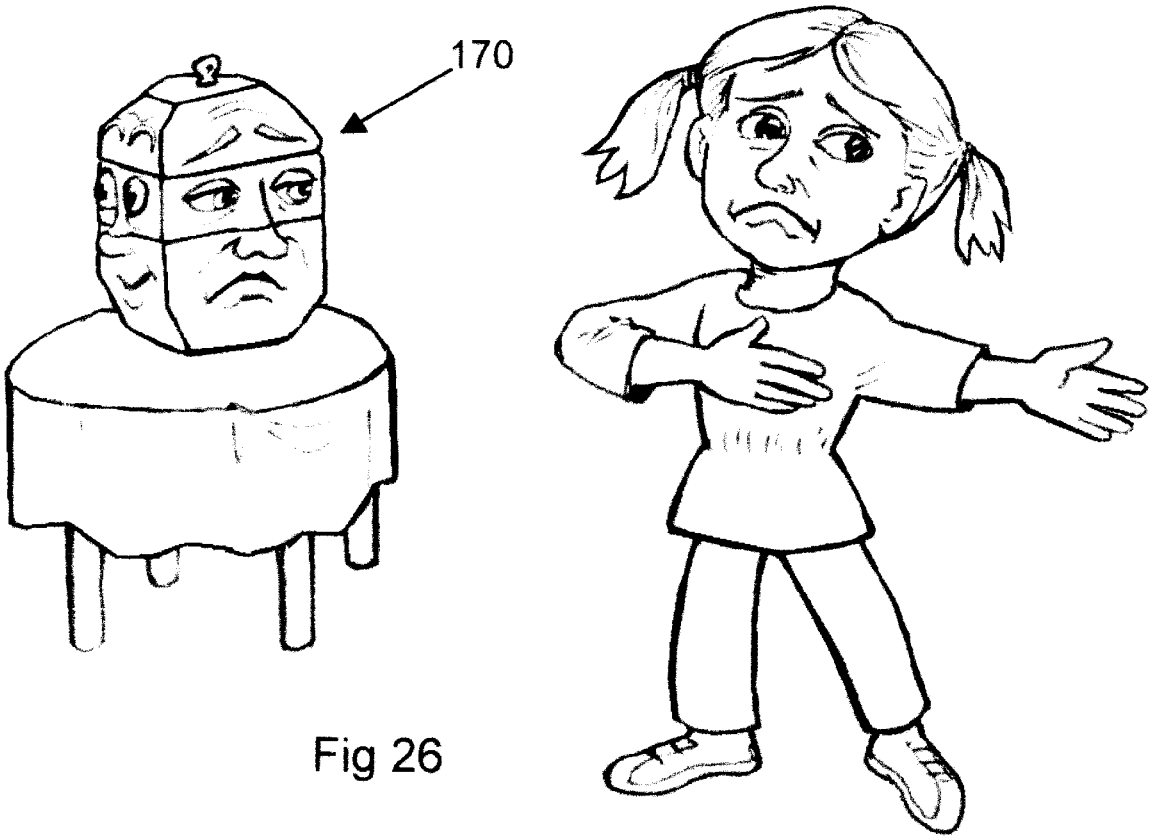
Figure 29:
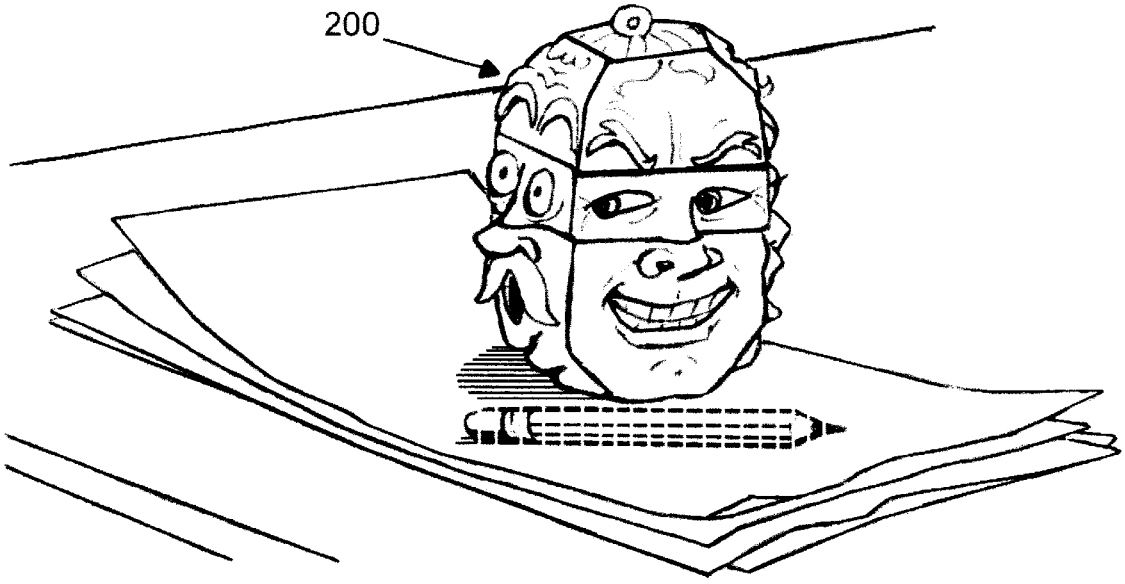

FIGS. 25, 26 and 29 illustrate devices shown at 150, 170 and 200 respectively for presenting alternative facial expressions in the form of a table top display, such as a halloween decoration or a theatrical workshop tool. In this case, either device, for example device 50, may be provided with a motor and a controller for moving the first, second and third portions 152, 154, 156.

Figure 27:
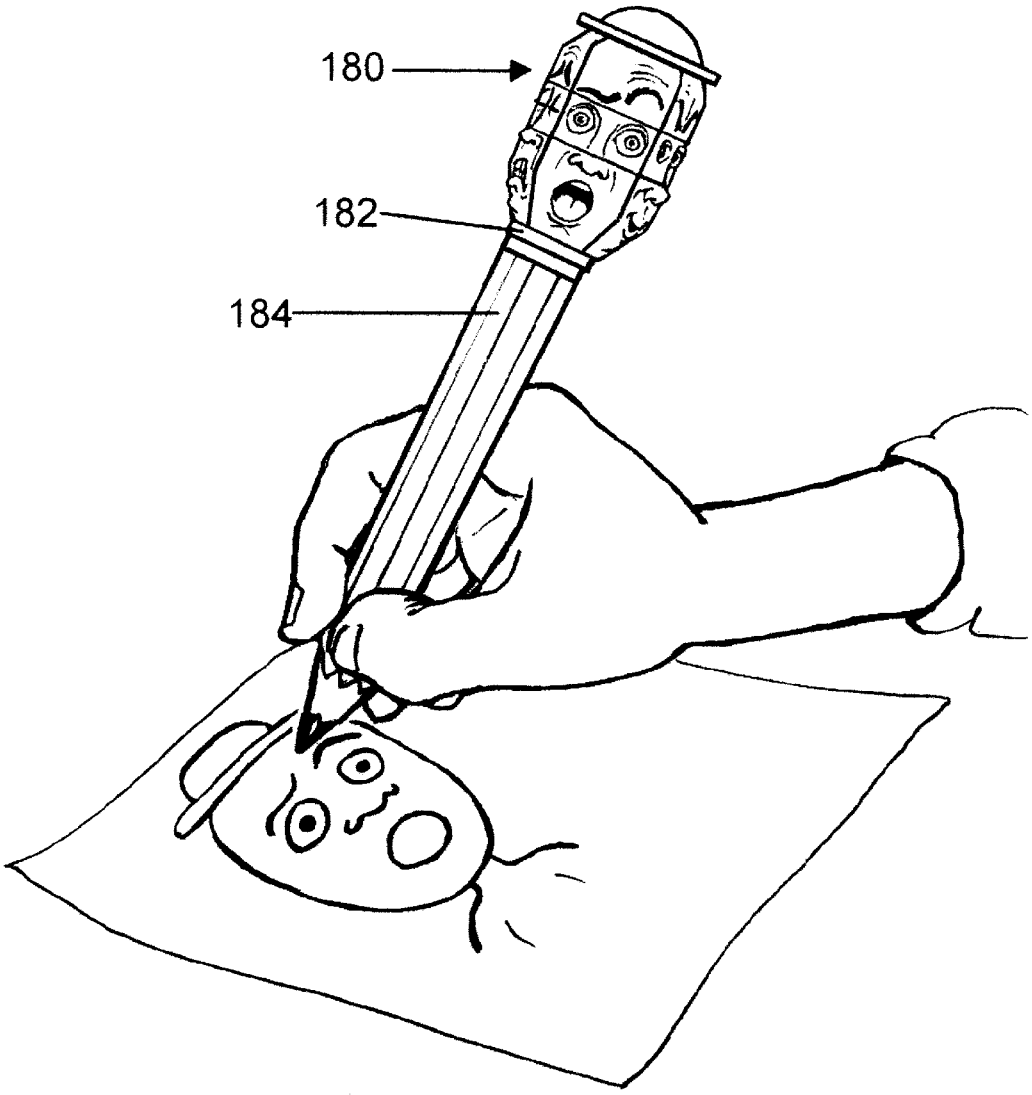

FIG. 27 illustrates still a further version of the device 180 for presenting alternative facial expressions. In this case, a mounting arrangement 182 is provided on the device for mounting it on one end of an elongate member, for example a shaft element such as a writing implement 184 in the form of a crayon, a pencil, a pen or the like.

Figure 30:
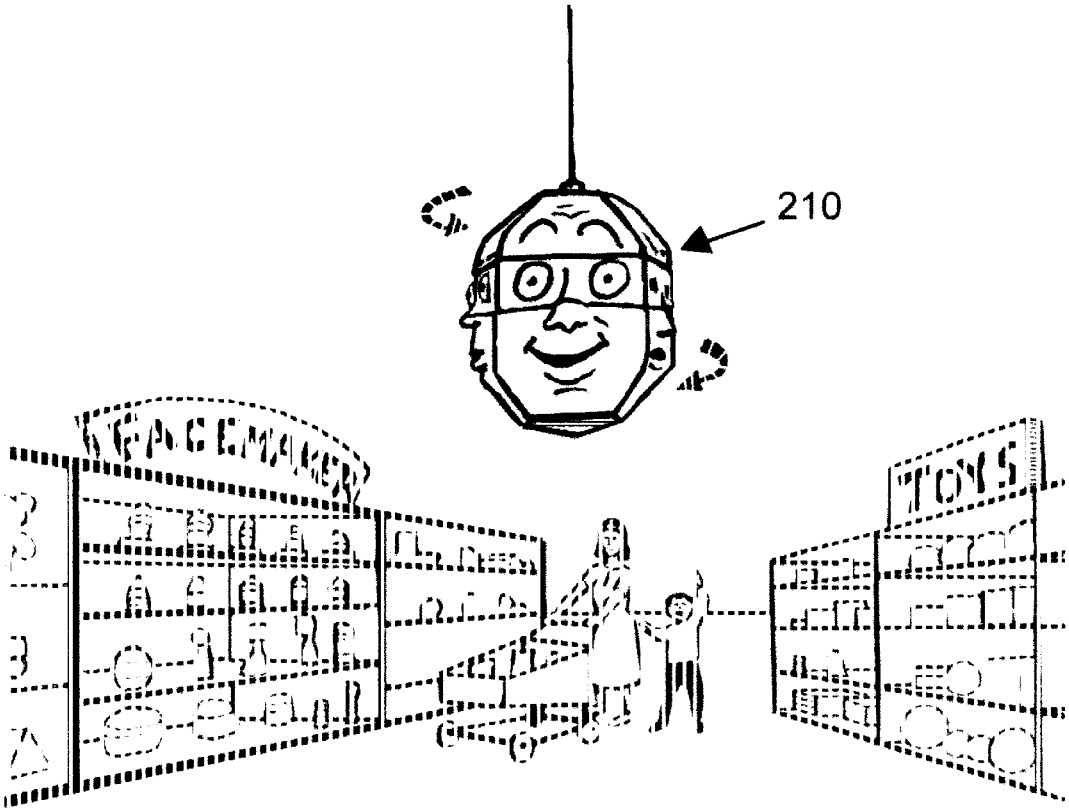

FIG. 30 illustrates a devices shown at 210 for presenting alternative facial expressions in the form of a display, suspended in similar fashion to the devices in FIG. 23 and 28. In this case, the device may be motorized as for the device in FIG. 25.

Figure 31:
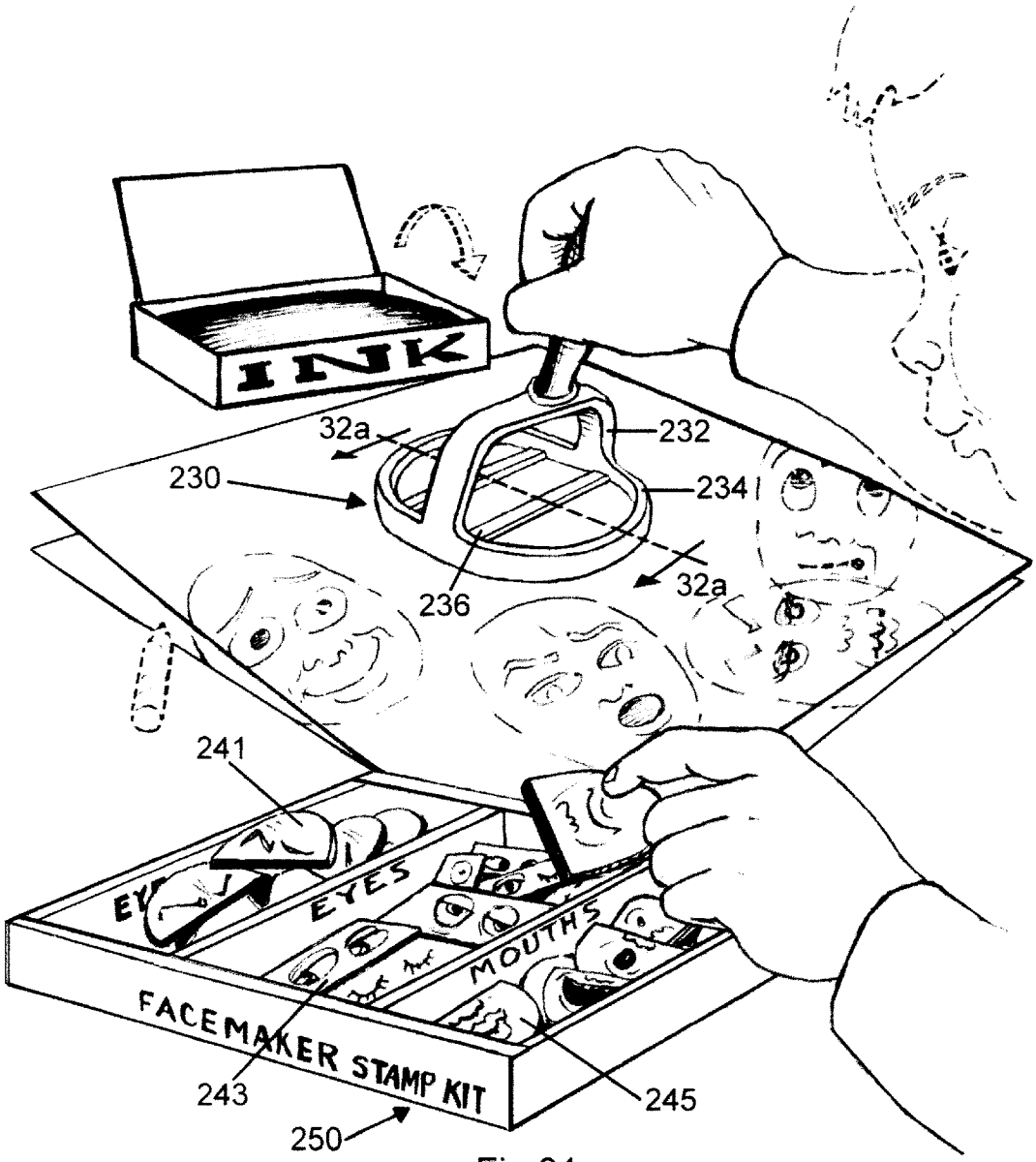
FIG. 31 is a perspective operational view of still another stamping device for presenting alternative facial expressions.
Figure 31A:
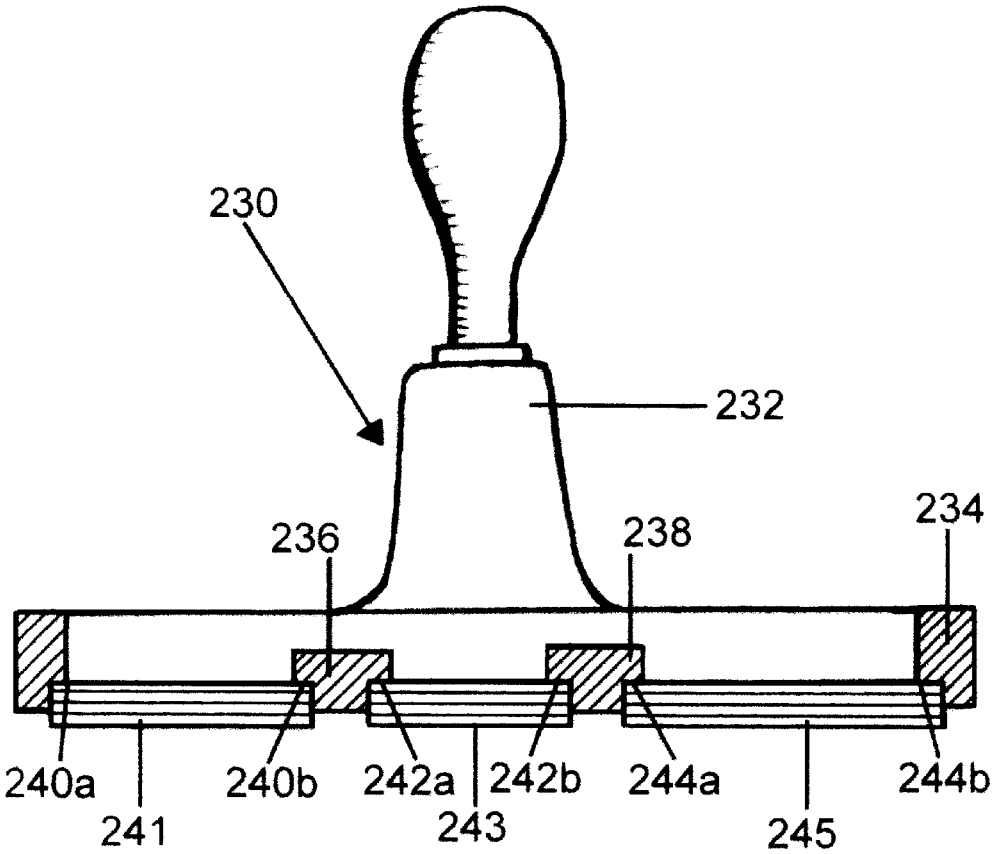
FIG. 31*a* is a sectional view taken on line 31*a*—31*a* of FIG. 31.

FIG. 31, 31*a* show a stamping device 230 for presenting alternative facial expressions. The device has a base frame 232 with an outer peripheral frame portion 234 and a pair of transverse frame portions 236, 238. The frame portions provide a series of corresponding seat surfaces for engaging a corresponding one of the stamp elements. For example, the frame portions provide seat surfaces 240*a*, 240*b* for engaging a stamp element 241 having a region including indicia representative of an upper section of a face including a pair of eyebrows. Seat surfaces 242*a*, 242*b* are also provided for engaging a stamp element 243 having a region having indicia thereon representative of a middle section of face and including a pair of eyes. As well, seat surfaces 244*a*, 244*b* are also provided for engaging a stamp element 245 having a region including indicia thereon representative of a lower section of the face and including a mouth.

A package of stamp elements is also provided at 250 including three compartments, each to hold a corresponding one of the stamp elements 241, 243 and 245.

Thus, the device 232 provides a system whereby a user can easily create various facial expressions for amusement or creative purposes, in this case, in the form of a stamp where the expressions can be impressed onto a suitable substrate by transferring ink thereto from an ink pad.

The user, in this case, selects the desired 'eyebrow', 'eye' and 'mouth' stamp elements 214, 243, 245 from the package 250 and each is mated to its corresponding seating surfaces on the frame portion 234. Substituting any one (or more) of the stamp elements will present a different facial expression, again depending on the stamp element and the particular representation selected.

Figure 32:
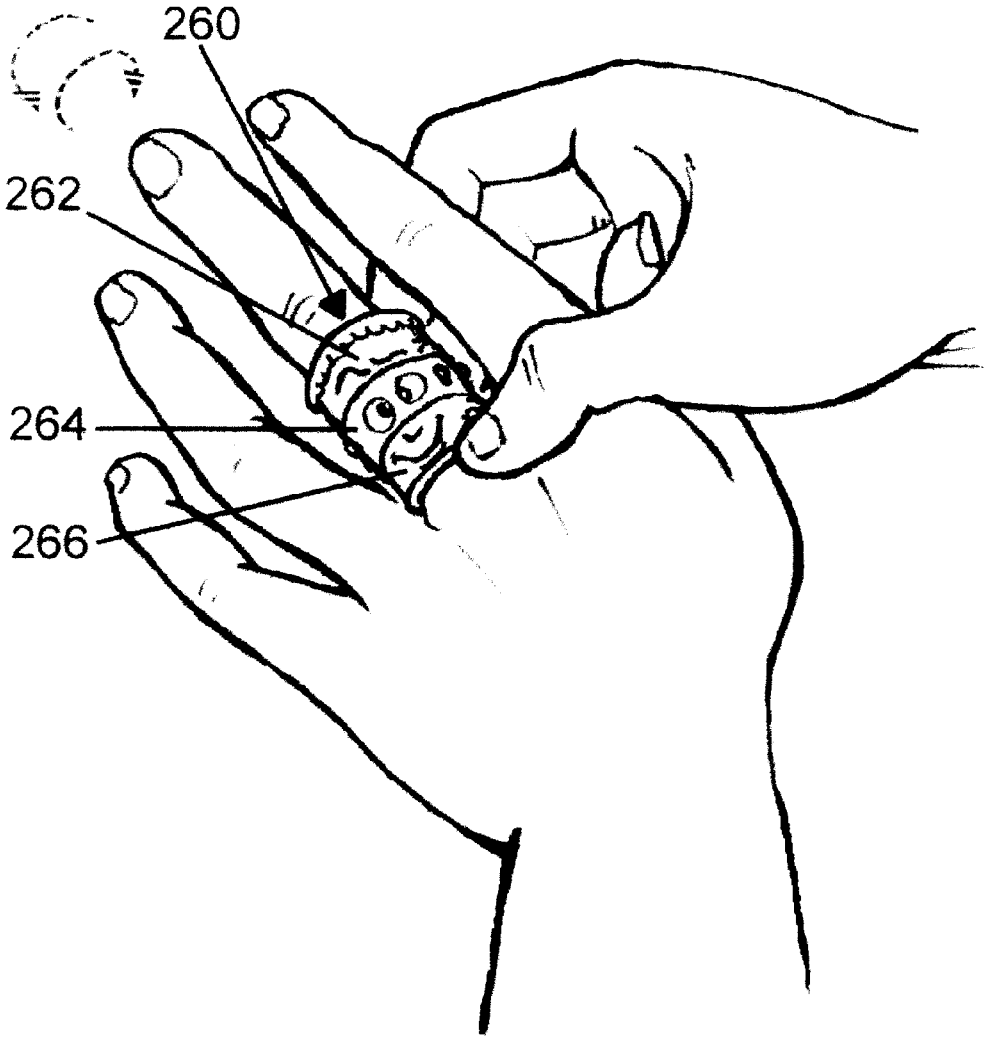
FIG. 32 is a perspective operational view of still another device for presenting alternative facial expressions.

FIG. 32 is a perspective operational view of still another device 260 for presenting alternative facial expressions. In this case, the first, second and third portions are dimensioned to engage the user's ring finger.

Figure 33:
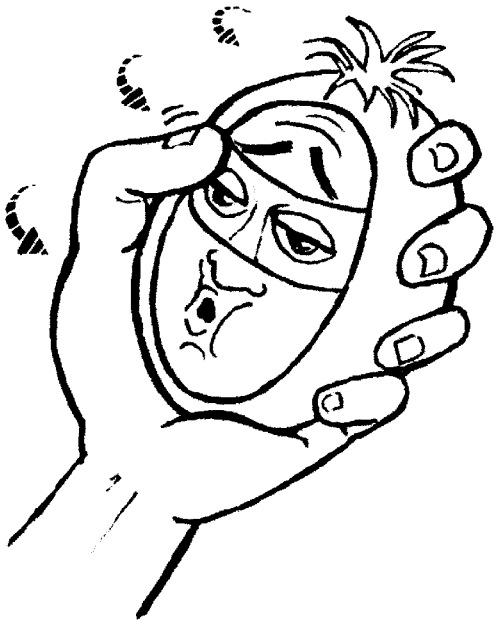
FIG. 33 is a perspective operational view of still another device for presenting alternative facial expressions.
Figure 33A:
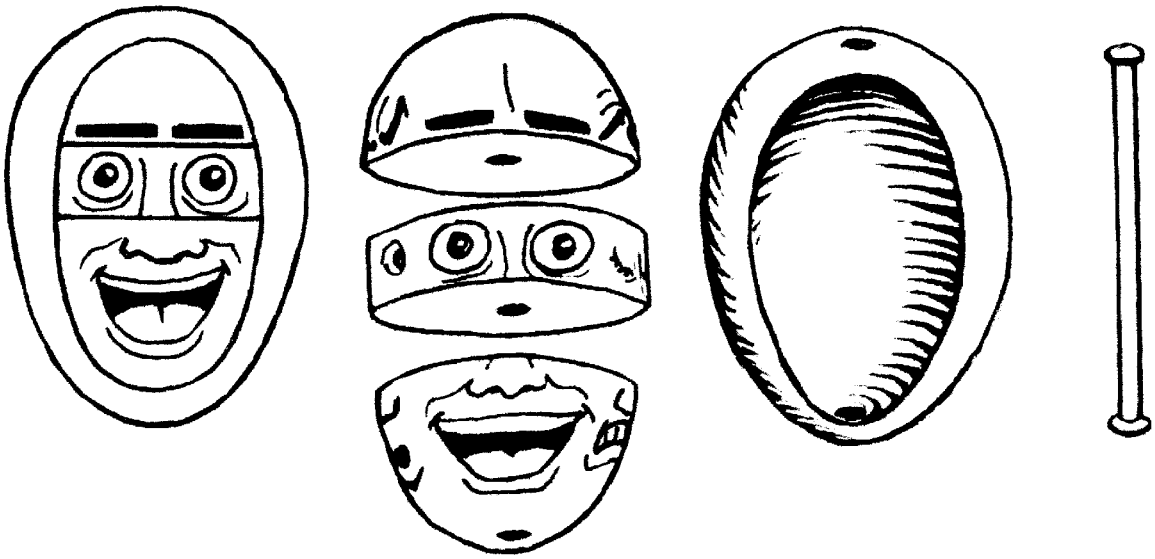
FIG. 33*a* is an exploded view of the device illustrated in FIG. 33.

FIGS. 33 and 33*a* illustrate another device 280 for presenting alternative facial expressions. In this case, the device has first, second and third portions 282, 284, 286 respectively which are movably installed in an egg-shaped housing 288. The portions are also pivotally held in the housing by way of a pivot rod 290 which extends through aligned passages 242*a*, 284*a*, 286*a* and 288*a* in the first, second, third portions and the housing respectively. A window 292 is also formed in the housing to expose a particular facial expression provided by a given combination of regions on the first, second and third portions.

Figure 34:
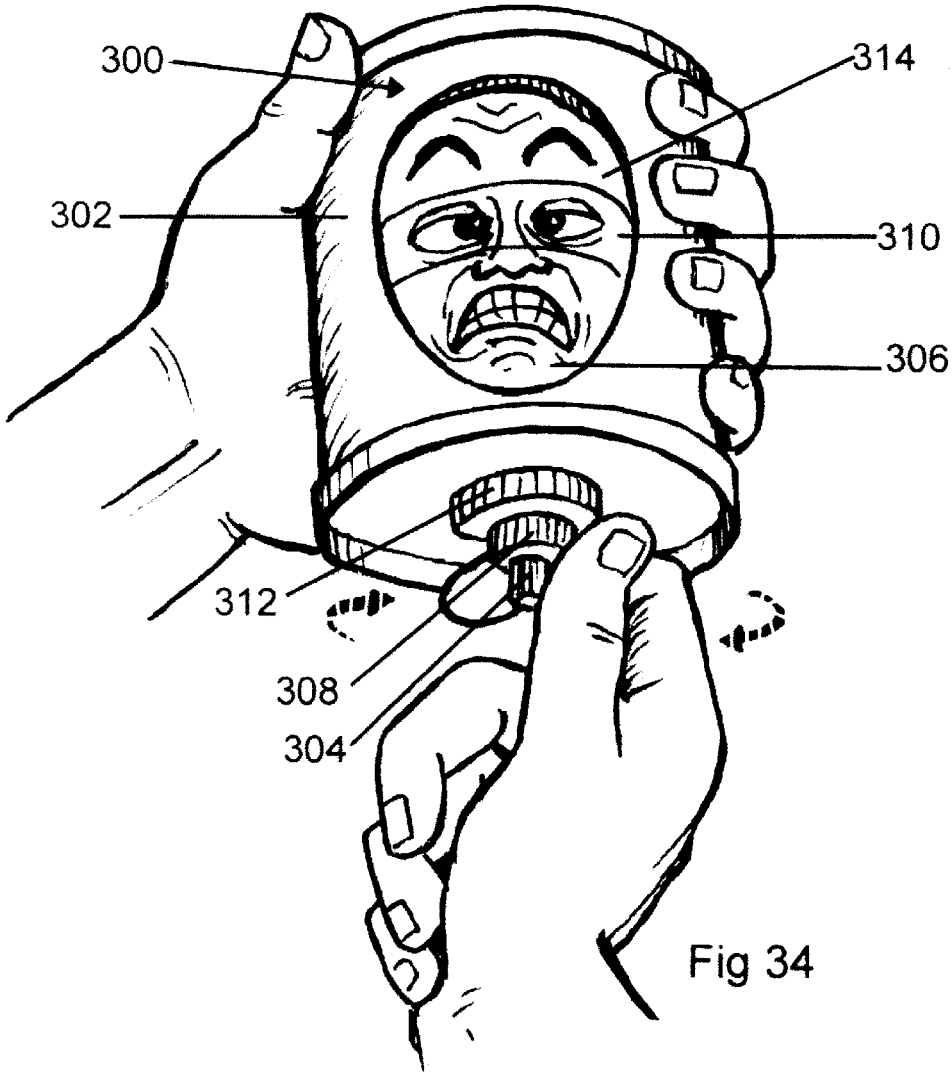
FIGS. 34 and 35 is a perspective operational view of still other devices for presenting alternative facial expressions.

FIG. 34 illustrates a device 300 which is similar to the device 280 except that the housing 302 is cylindrical rather than egg shaped as before. IN addition, the pivot rod is formed with a inner section 304 to move the third portion 306 a middle section 308 to move the second portion 310 and an outer section 312 to move the first portion 314.

Figure 35:
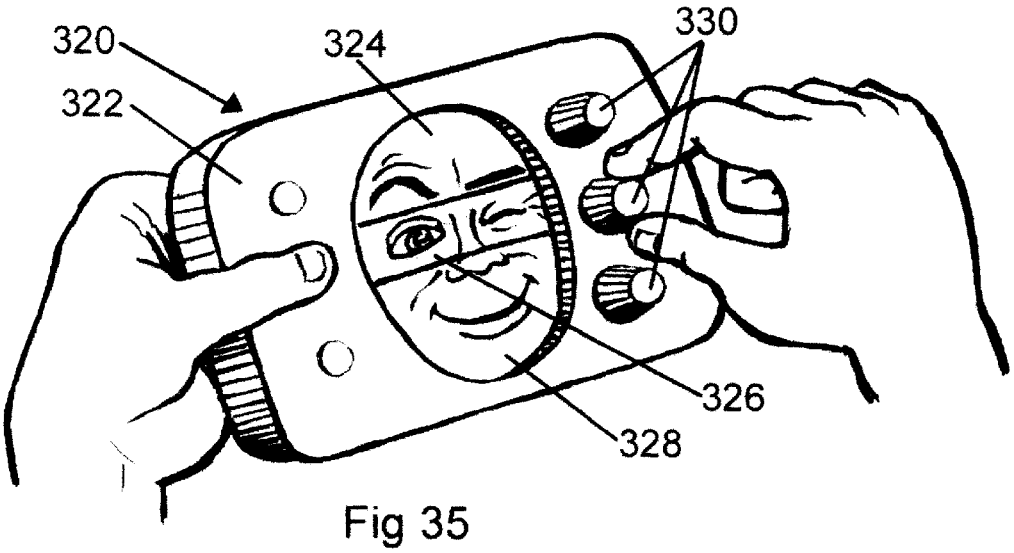

FIG. 35 illustrates a device 320 which has a housing 322 with a number of portions therein in the form of tapes 324, 326 and 328 which carry a series of different representations as above. In this case, the device is further provided with activation knobs shown collectively at 330 to select a particular region on a corresponding tape for a particular facial expression.

What is claimed is:

1. A device for presenting simultaneous alternative facial expressions, comprising:

a first block member having a plurality of first regions, each first region including a representation of an upper section of a face and exclusively containing a pair of eyebrows, wherein the representations in the first regions differ from one another;

a second block member having a plurality of second regions, each second region including a representation of a middle section of a face and including a pair of eyes; wherein the representations in the second regions differ from one another;

a third block member having a plurality of third regions, each third region having a representation of a lower section of a face and exclusively containing a mouth and a lower portion of a nose, wherein the representations in the third regions differ from one another;

said first and second block members having complement borders and said second and third block members having complementary borders in order to present any one of a number of possible facial expressions when a first region is aligned with a second region and a third region wherein said first block has a tapered upper portion and said third block has a tapered lower portion.

2. A device for presenting simultaneous alternative facial expressions, comprising:

a first block member having a plurality of first regions, each first region including a representation of an upper section of a face and exclusively containing a pair of eyebrows, wherein the representations in the first regions differ from one another;

a second block member having a plurality of second regions, each second region including a representation of a middle section of a face and exclusively containing eyes; wherein the representations in the second regions differ from one another;

a third block member having a plurality of third regions, each third region having a representation of a lower section of a face and exclusively containing a mouth and a lower portion of a nose, wherein the representations in the third regions differ from one another;

said first and second block members having complementary borders and said second and third block members having complementary borders in order to present any one of a number of possible facial expressions when a first region is aligned with a second region and a third region;

wherein the first, second and third block members have an equal number of regions thereon, the representations on the first, second and third block members are in relief, and attachment means for attaching said first, second and third block members together for relative movement between, said attachment means includes a projection formed in one of said block members and a complementary recess formed in an adjacent one of said block members, each projection and recess having the same number of sides.

3. A device as defined in claim 2 wherein said cach projection and recess are separable.

4. A device for presenting simultaneous alternative facial expressions, comprising:

a first block member having a plurality of first regions, each first region including a representation of an upper section of a face and exclusively containing a pair of eyebrows, wherein the representations in the first regions differ from one another;

a second block member having a plurality of second regions, each second region including a representation of a middle section of a face and including a pair of eyes; wherein the representations in the second regions differ from one another;

a third block member having a plurality of third regions, each third region having a representation of a lower section of a face and exclusively containing a mouth and a lower portion of a nose, wherein the representations in the third regions differ from one another;

said first and second block members having complementary borders and said second and third block members having complementary borders in order to present any one of a number of possible facial expressions when a first region is aligned with a second region and a third region;

wherein the representations on the first, second and third block members are in relief.

5. A device as defined in claim 4 wherein said first block has a tapered upper portion and said third block has a tapered lower portion.

6. A device as defined in claim 4, further comprising a pair of tapered extremities, thereby giving the device an ovoid shape.

7. A device for presenting a number of facial expressions at the same time, comprising a body with an axis, said body being sliced through said axis into an upper portion, a middle portion and a lower portion, said portions being operable for independent rotating about said axis, attachment means for attaching said portions together, each portion having a peripheral surface formed from a number of facets, wherein the number of facets on each portion is the same and wherein each facet includes a number of facial features:

each facet of the upper portion includes a forehead down to a top of a bridge of a nose exclusively containing a pair of eyebrows, each facet of the middle portion includes a top of a bridge of a nose to a middle of the bridge and exclusively containing eyes, and each facet of the lower portion includes a lower portion of the nose to a bottom of a chin and exclusively containing a mouth, wherein, when any one portion is partly rotated to align different facets together, new facial expressions appear around the body wherein the facial features on each facet are in relief.

* * * * *